US005337705A

United States Patent [19]

Lane

[11] Patent Number: 5,337,705

[45] Date of Patent: Aug. 16, 1994

[54] HIGH PERFORMANCE COOLANT SYSTEM WITH MANIFOLD FOR LARGE DIESEL ENGINES

[76] Inventor: Christopher K. Lane, 13624 E. Nelson Ave., City of Industry, Calif. 91746

[21] Appl. No.: 87,604

[22] Filed: Jul. 6, 1993

[51] Int. Cl.[5] ..... F01P 11/08

[52] U.S. Cl. ..... 123/41.33; 123/196 AB

[58] Field of Search ..... 123/41.33, 196 AB

[56] References Cited

U.S. PATENT DOCUMENTS

| | | | |
|---|---|---|---|
| 4,370,957 | 2/1983 | Skatsche et al. | 123/41.33 |
| 4,520,767 | 6/1985 | Roettgen et al. | 123/41.33 |
| 4,834,171 | 5/1989 | Larrabee et al. | 123/196 AB |
| 4,896,718 | 1/1990 | Trin | 123/41.33 |

*Primary Examiner*—E. Rollins Cross
*Assistant Examiner*—Evick Solis
*Attorney, Agent, or Firm*—Roberts andd Quiogue

[57] ABSTRACT

A cooling manifold for large diesel engine systems, disposed between a lubrication oil cooler and the engine system coolant pumps. The manifold system provides an increased coolant flow area at the oil cooler outlet housing, with associated improvement in both the total coolant flow rate and the distribution of that flow in the oil cooler heat exchange tubes. The increased flow is provided by additional inlet ports, which also enhances the flow distribution. High velocity flow tubes direct a localized stream of high velocity coolant, obtained directly from the discharge of the engine coolant pumps via a recirculation line, to assure proper Net Positive Suction Head and prevent vortex void formation in the coolant pump suction during peak operating conditions. The manifold can be retrofitted on existing diesel engines, or installed in the engine system during manufacture.

13 Claims, 5 Drawing Sheets

HIGH PERFORMANCE COOLANT SYSTEM WITH MANIFOLD FOR LARGE DIESEL ENGINES

BACKGROUND OF THE INVENTION

The present invention relates to the distribution and amount of flow of coolant through an oil cooler to the suction side of main coolant pumps on large diesel engines.

Heavy-duty diesel engines are used in a wide variety of applications including locomotives, oil drilling rigs, electrical generation and marine propulsion. These engines come in a range of sizes involving different numbers and sizes of cylinders as well as different arrangements of blowers and/or turbo-chargers. In the larger sizes, specifically for the high capacity, turbo-charged, 16 and 20 cylinder versions, problems with adequate engine cooling, particularly as manifested by excessive engine oil temperatures, can occur. High coolant system pressures are sometimes employed with these systems, which require higher rated cooling system components including radiator cores, with associated higher costs.

SUMMARY OF THE INVENTION

An improved cooling system is described for large diesel engine systems including coolant pumps and a lubrication oil cooler having coolant passages through which coolant is pumped to cool the oil. The oil cooler includes a plurality of outlet ports from which coolant flows toward the coolant pumps. These outlet ports include first and second outer ports, and, in accordance with the invention, at least one inner port disposed between the outer ports.

In accordance with the invention, a coolant manifold assembly distributes the coolant between the oil cooler outlet passages and the inlet suction ports of the coolant pumps. The manifold assembly includes a manifold body, a manifold coolant output port corresponding to each suction inlet port, a plurality of manifold inlet ports comprising an inlet port corresponding to each oil cooler outlet port, and flow distribution means for providing shortened flow paths between the inlet ports corresponding to the inner cooler outlet ports and the manifold outlet ports.

Means are provided for connecting the manifold outlet ports to the corresponding pump suction inlet ports, and for connecting the manifold inlet ports to the corresponding oil cooler outlet ports.

The improved cooling system provides improved coolant flow through the oil cooler without the necessity for additional coolant pumps.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
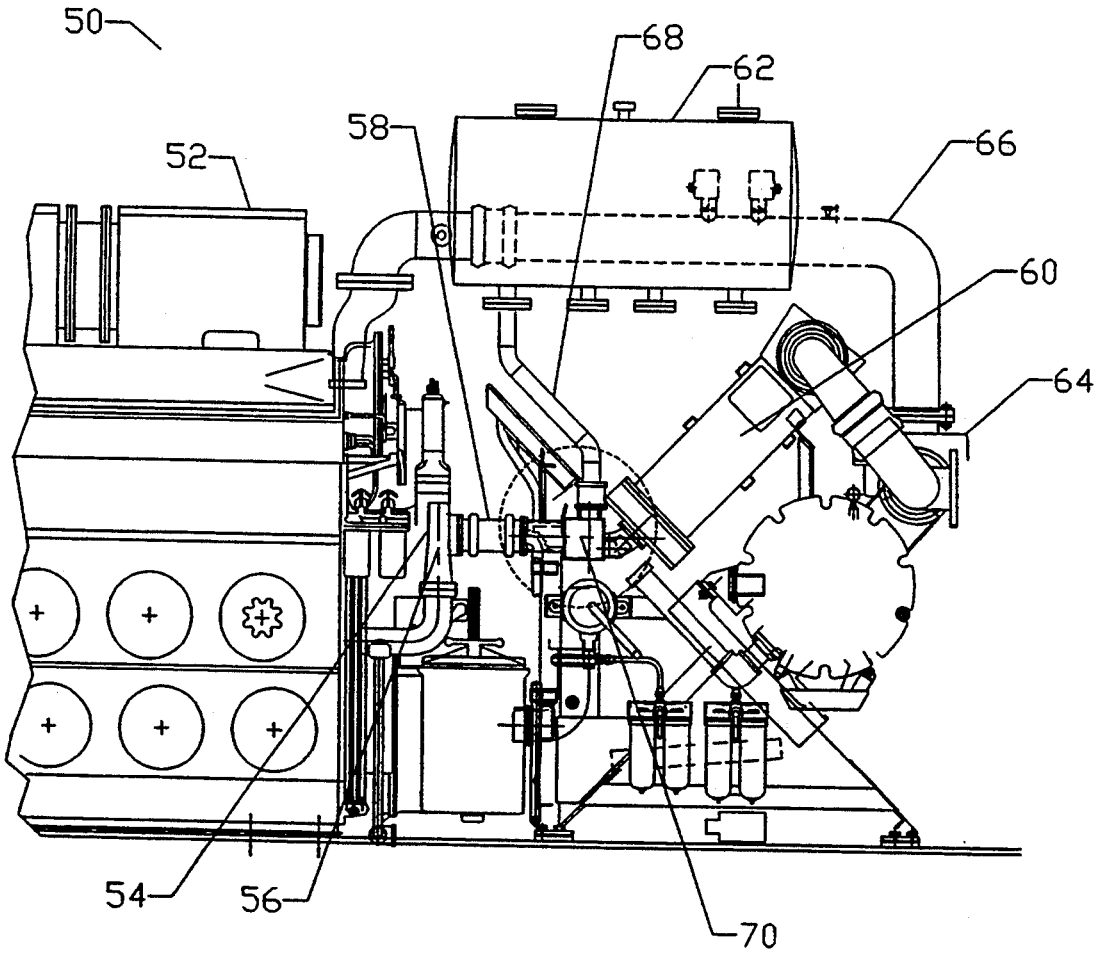
FIG. 1 is a side view of a large diesel engine system embodying the invention, illustrating the location of the high performance cooler manifold between the lubrication oil cooler and the coolant pumps.

The preferred embodiment of this invention is described in the context of a series of large diesel engines known as "Electro-Motive Diesels," manufactured by the Electro-Motive Division (EMD) of General Motors Corporation. It will be appreciated that the invention is not limited to improvements in EMD engines, but instead may be employed in other large diesel engines as well.

The large diesel engine systems employ a coolant system which includes typically two coolant pumps which pump coolant (typically a mixture of water and an anti-freeze solution) into the engine block. The pumps include suction inlets which receive coolant which is recirculated from the engine, having passed through a radiator(s) if necessary to cool the coolant to a desired temperature range, and which after cooling is passed through a lubrication oil cooler to cool the engine lubrication oil.

In a typical EMD engine system, a device called an aspirator is fitted in the coolant path between the oil cooler head and the pump suction inlets. The aspirator includes ports connected to a surge tank, ports which are connected to the two head outlets at the oil cooler, and two outlet ports which are connected to the suction inlets of the coolant pumps. The aspirator also includes a high pressure coolant line for recirculating coolant under pressure. The aspirator incorporates a venturi where the main flow stream of coolant is accelerated, creating a localized zone of higher velocity and lower pressure. In the vicinity of this venturi are the connection points for both the coolant surge tank and the recirculation line. The combination of the venturi and the pressurized recirculation provides a localized high velocity flow stream of coolant toward the general vicinity of the associated coolant pump suction to aid in avoidance of pump cavitation.

The invention replaces the aspirator with a simple flow tube with significantly more flow area and, thus, lower flow velocities, and incorporates high velocity "jet" nozzles immediately upstream of the pump suction which is aimed directly at the center of the pump impeller. The recirculation jet assures avoidance of pump cavitation even with the higher overall coolant flow which is the result of the invention and which would otherwise be associated with increased likelihood of cavitation.

Testing of a "factory standard" EMD diesel engine which was experiencing both oil cooling and high radiator pressure problems revealed a single cause for both of these phenomena, a choke point at the exit of the conventional lubricant oil cooler. It was determined through a series of controlled tests that the factory standard design involved a large pressure drop, approximately 15 PSID, across the two exit ports of the conventional lubricant oil cooler. Reconfiguration of the lubricant oil cooler outlet casting from two to five exit flow ports combined with the installation of a high performance cooling manifold in accordance with the invention provides dramatic improvements in both oil cooling and radiator pressure. For example, using a 20 cylinder EMD (Model 20-645-F4B) engine, oil cooling capacity improved almost 34% (from 26 degrees F. cooling to 35 degrees F. cooling of oil at full load) and radiator pressure was reduced from approximately 25 PSIG to around 6 PSIG.

FIG. 1 illustrates an EMD-type large diesel engine system 50, comprising an EMD engine 52, and two engine coolant pumps 54 and 56. A lubricant oil cooler 60 is connected to the pumps 54 and 56 through a coolant manifold assembly 70, in accordance with this invention. The coolant manifold assembly 70 includes connections to a conventional surge tank 62. Coolant is recirculated from the engine 52 via a pipe 66 to a mixing valve 64, which directs the coolant from the engine either into the oil cooler 60, if the temperature of the coolant is sufficiently low, or to a radiator (not shown) to be cooled. The coolant passed through the radiator is returned to the oil cooler 60, to cool the engine lubrication oil.

Figure 2:
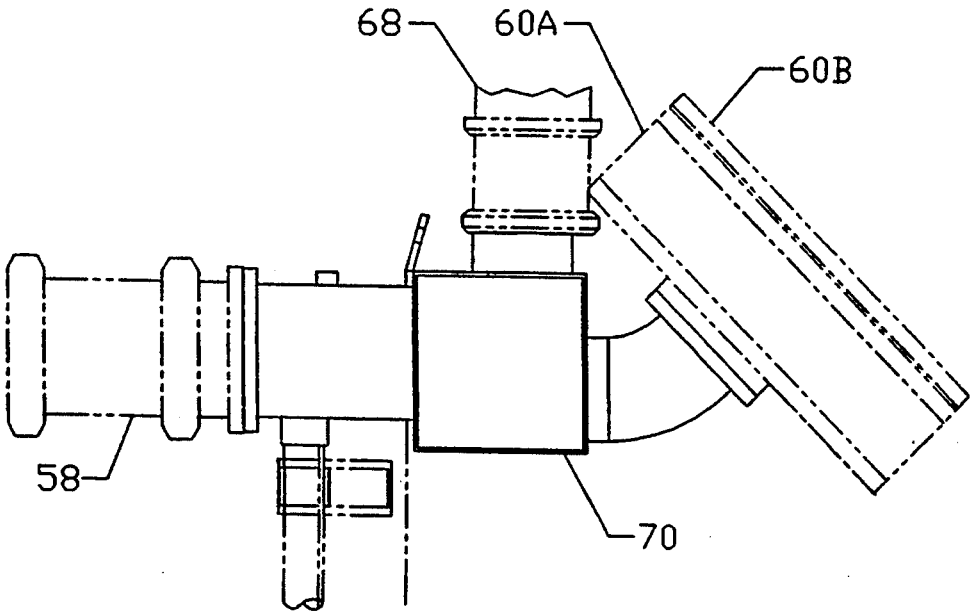
FIG. 2 is a close-up view of the cooler manifold assembly employed in the engine system of FIG. 1.

FIG. 2 is a close-up view of the area shown in the phantom circle of FIG. 1, showing the connection of the manifold 70 to the surge tank 62 via pipe 68, to the oil cooler head 60A, and to coolant pumps via pipes 58.

Figure 3:
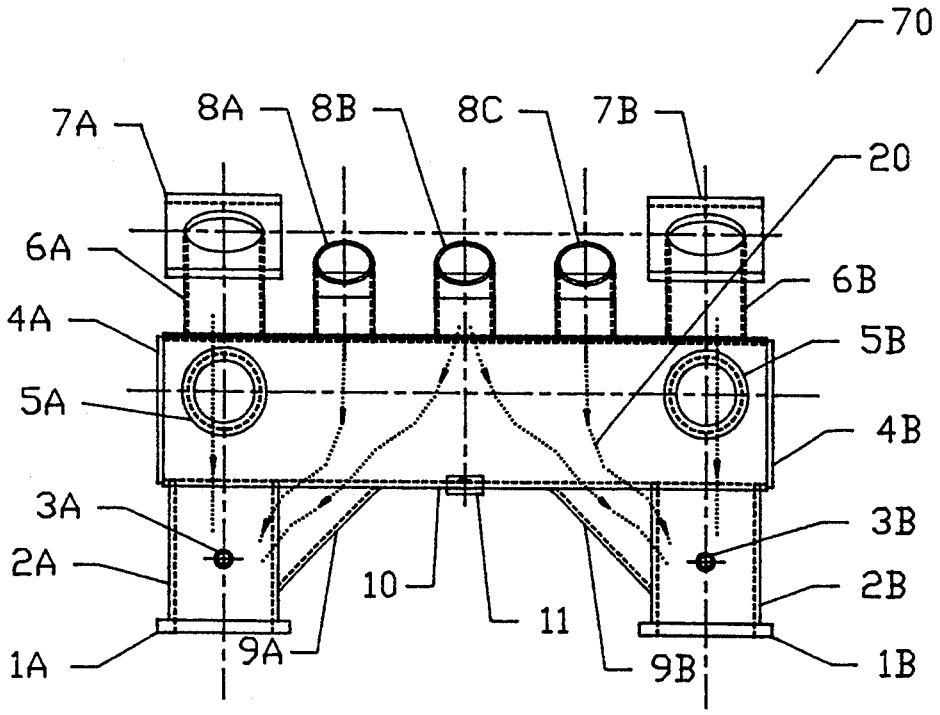
FIG. 3 is a top view of the coolant manifold assembly of FIG. 1.

Referring to FIG. 3, a top view of the main manifold assembly 70, the manifold outlet flanges 1A and 1B connect to adjustable suction coupling pipes 58 of the diesel engine coolant pumps 54, 56 when the manifold assembly 70 is installed in the engine system 50. These outlet flanges 1A and 1B are welded to pipes 2A and 2B respectively to form a flanged pipe connection. The pipe 2A and 2B have a nominal four inch inner diameter dimension.

Items 3A and 3B are small internally threaded couplings welded to drilled penetrations which are used for connection of test instrumentation as desired or plugged with pipe plugs. End plates 4A and 4B of the main manifold assembly 70 combine with body 10 to form the flow transition piece of the manifold assembly.

Items 5A and 5B are the threaded couplings for installation of threaded pipe nipples to connect the manifold 70, and the cooling system in general, to the main coolant surge tank 62, a component of the conventional EMD diesel engine system. 45 degree elbow pipes 6A and 6B connect to the two outboard flow ports of the oil cooler 60 by flanges 7A and 7B. Center flow enhancing slot pieces 9A and 9B are installed to improve flow characteristics of the portion of coolant flow from the middle portion of the manifold 70 which accepts coolant flow from the three inboard header pipes 8A, 8B and 8C. The slot pieces 9A and 9B extend between slots formed in the body 10 and the sides of the outlet pipes 2A and 2B, and effectively define channel members through which coolant may flow from the inner inlet ports 8A–8C to the outlet pipes 2A and 2B. The slot pieces 9A and 9B effectively shorten the fluid travel path distance from the new inner inlet pipes 8A–8C to the two outlet pipes 2A, 2B. Phantom lines 20 indicate exemplary coolant flow lines from the ports 7A, 7B, 8A, 8B and 8C into respective output pipes 2A and 2B. A mounting bracket 11 is used in conjunction with a standard turnbuckle (not shown) or other threaded attachment hardware for support of the manifold 70 in the installed position.

Certain elements have been omitted from FIG. 3 for clarity, including the high velocity flow tubes and associated connections to the recirculation hose Tee, discussed below.

Figure 4:
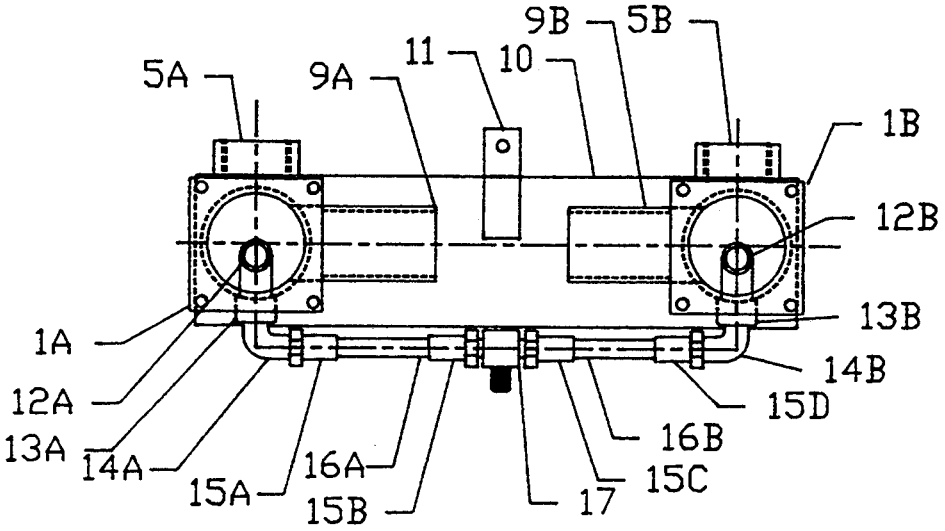
FIG. 4 is a front view looking from the direction of the diesel engine coolant pumps at the outlet flanges of the cooler manifold.

FIG. 4 shows a front view of the coolant manifold assembly 70. This view illustrates the high velocity flow tubes 12A and 12B, welded to pipes 2A and 2B, as is apparent looking from the suction side of the diesel engine coolant pumps. Internally threaded connection half-couplings 13A and 13B are for installation of elbows 14A and 14B to other portions of a recirculation Tee 17 by hoses and fittings 15A–15D and 16A–16B. The recirculation Tee 17 is connected to a high pressure port (not shown) of the coolant pumps 54, 56.

Figure 5:
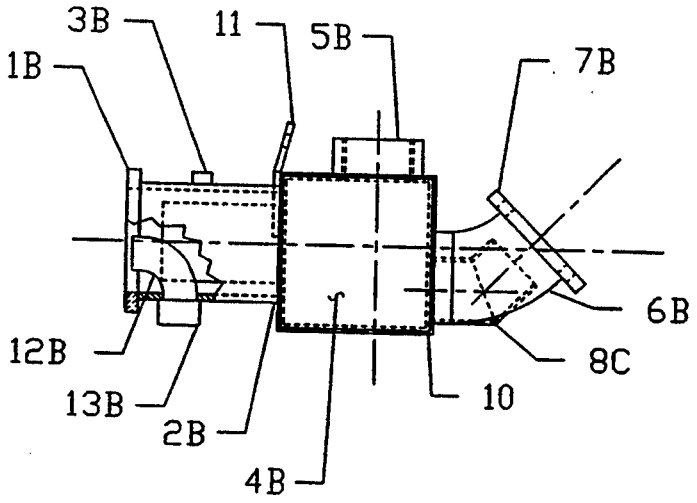
FIG. 5 is a side view of the manifold assembly with a cutaway to reveal the high velocity flow tube arrangement installed in the manifold outlet pipe.

In FIG. 5, the side or profile view of the manifold assembly 70 is shown with a cutaway of the high velocity flow tube 12B and a hidden view of the inboard header pipes 8A–8C. As shown therein, the tubes 12A and 12B include bends in the range of 70 to 80 degrees, so that the tube ends terminate slightly below the center of the pipe openings in the flanges 1A and 1B, to result in the intersection of the high velocity coolant jets from the ends of tubes 12A and 12B at the direct center of the pump suction. Thus, high pressure streams of coolant are directed into the center of the suction inlets of the pumps, which typically include centrifugal impeller elements. The high pressure streams act to limit or eliminate cavitation within the pumps.

Figure 6:
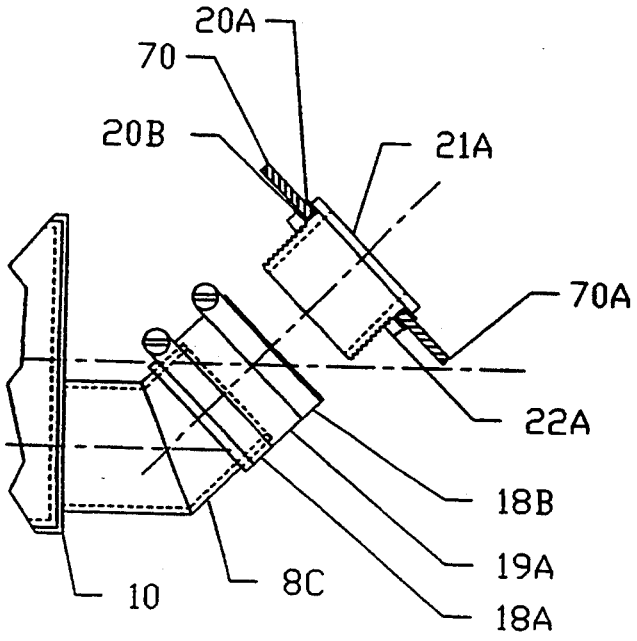
FIG. 6 is an expanded profile view of one of the three identical hose connected inlet pipes, shown with the connection hose and clamps and a segment of the oil cooler stub nipple gaskets and packing nut.

FIG. 6 is an expanded view showing the profile of an exemplary one 8C of the three inboard header pipes 8A–8C as it is connected with one 19A of three stub hoses 19A–19C, and to one 21A of three oil cooler outlet stub nipples 21A–21C with hose clamps 18A–18B. Alternatively, the cooler outlet head can be built-up and machined to a five port machined flange with the addition of four bolts or studs per new port. FIG. 6 illustrates the installed arrangement of one of the oil cooler outlet stub nipples as it seats with inner gasket 20A against the inner surface 70A of the oil cooler 70 and attached with one of three packing nuts 22A–22C with an outer gasket 20B.

Figure 7:
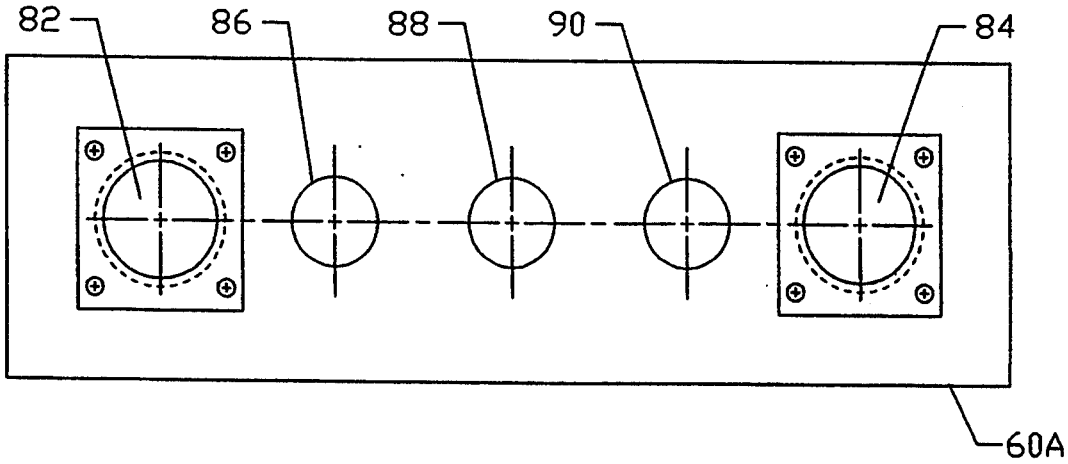
FIG. 7 shows the exit ports of the lubrication oil cooler of the engine system of FIG. 1, including the factory standard two outboard ports and associated bolt holes, and the three inner ports which are added in accordance with the invention to accommodate the high performance cooler manifold assembly.

FIG. 7 is a view of the lower head 60A of the oil cooler 70, showing both the factory standard outer two flow ports 82 and 84 and associated threaded bolt holes, and the three inner ports 86, 88 and 90 which are added to the factory standard design in accordance with the invention to connect to corresponding ports 8A, 8B and 8C of the high performance cooler manifold 70. In an exemplary embodiment, the three added inner ports have a nominal diameter of 2.125 inches, and the factory standard ports have a nominal diameter of 3 inches.

Figure 8:
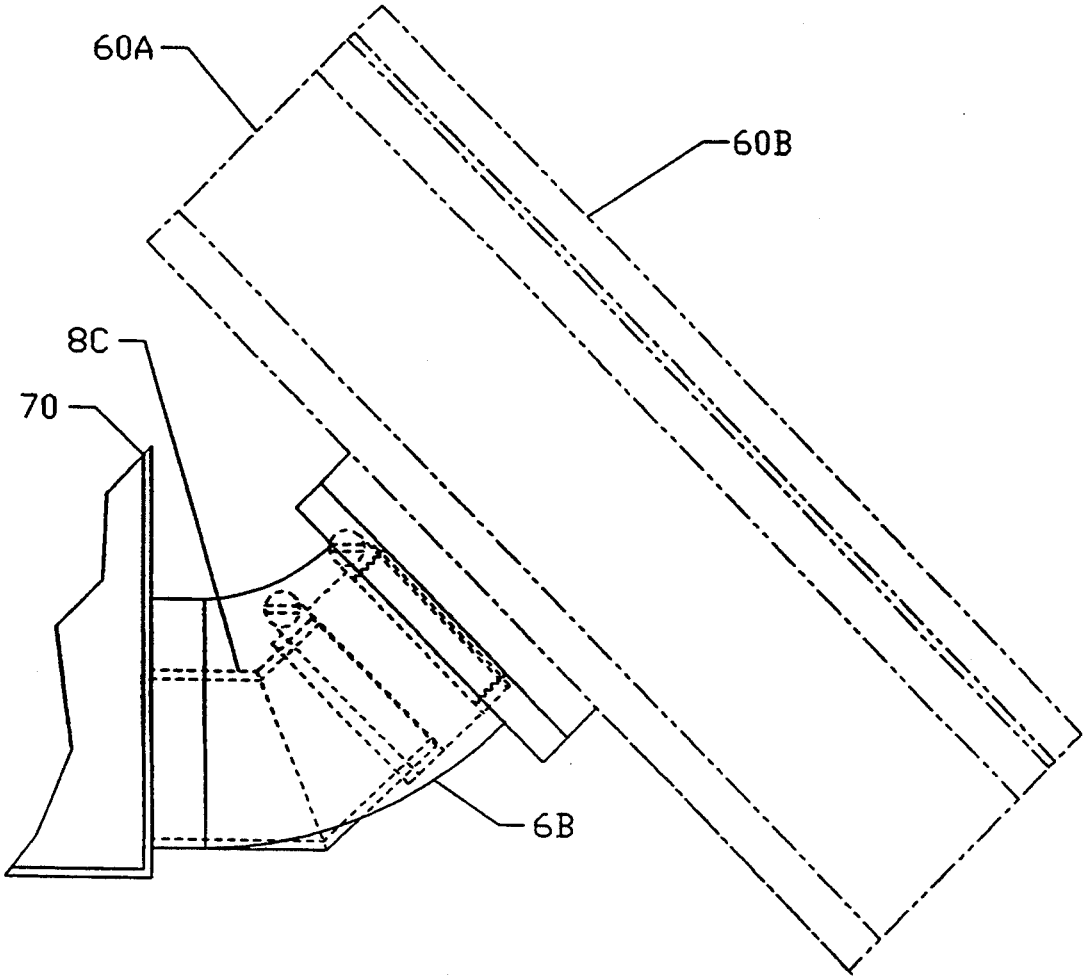
FIG. 8 is a close-up side view of the manifold connections to the oil cooler outlet head.

FIG. 8 is a side view of the interconnection of the cooler manifold 70 to the oil cooler head 60A of the lubrication oil cooler 60.

The high performance coolant manifold assembly 70 provides a dramatic improvement in coolant flow and engine oil cooling with no change of engine coolant pumps or other cooling system components. This is accomplished by increasing the available flow area of the oil cooler outlet casting with associated improvement in both the total coolant flow rate and the distribution of that flow in the oil cooler heat exchange tubes. Flow distribution is improved by normalizing the flow velocities of coolant through the cooler tubes. In the factory standard version, coolant flow tends to be concentrated, or channeled in the region close to the two exit ports. The necessity to establish the very high coolant flow velocities at the location of the ports, and the close proximity of the cooler tube sheet to these ports, dictates that the majority of the flow is through cooler tubes in close proximity to the exit ports. With the invention, the flow velocities are greatly reduced by the addition of additional flow area; also, the exit ports are increased from two to five and are distributed along the entire length of the cooler lower head 60B. This combination results in more normalized, lower velocity flow through more tubes and thus, improved use of the available cooler surfaces. In the exemplary embodiment, for a 20 cylinder EMD diesel engine system, the available flow is increased by addition of three 2.125 inch diameter ports with the standard two 3 inch (nominal) diameter ports, resulting in an increase in flow area from 14 square inches to about 25 square inches, an increase of approximately 75%. In addition to the added flow area, the position of the new ports enhances the distribution of flow in the lubricant flow cooler which further improves cooler effectiveness. The added flow area also provides for a dramatic reduction in coolant loop pressures as exemplified by the decrease from 25 PSIG to 6 PSIG on this exemplary unit as measured at the radiator outlet, and a reduction of the differential pressure at the oil cooler outlet head from approximately 15 PSID to less than 2 PSID.

Another important feature of the cooling manifold 70 is the presence of the two high velocity flow tubes 12A and 12B. These tubes direct a localized stream of high velocity coolant, obtained directly from the discharge of the engine coolant pumps via a small (1 inch diameter nominal) recirculation line, to assure proper Net Positive Suction Head (NPSH) and to specifically prevent vortex formation in the coolant pump suction during peak operation conditions. Such vortex voids might induce undesirable flow oscillations if allowed to form.

The invention is suitable for implementation as a kit for retrofit on existing diesel engine systems, and also for implementation on new production engine systems.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. In a large diesel engine system including a lubrication oil cooler through which is circulated coolant and which comprises a plurality of cooler outlet ports, one or more engine coolant pumps having one or more suction inlet ports for receiving coolant from said oil cooler, a coolant manifold assembly comprising:

a manifold body;

a coolant outlet port defined in said manifold body for each coolant pump suction inlet port, wherein each manifold outlet port is for connection to a corresponding pump suction inlet port;

a plurality of coolant inlet ports defined in said manifold body, wherein the number of coolant inlet ports is greater than the number of coolant outlet ports;

said manifold body comprising means for distributing coolant flow from said inlet ports to said one or more outlet ports, wherein said cooler manifold provides improved coolant circulation through said oil cooler.

2. The manifold assembly of claim 1 wherein said engine system includes two coolant pumps, said number of coolant inlet ports is two, and wherein said manifold coolant inlet ports comprises first and second outer inlet ports, and one or more inner inlet ports disposed between said outer inlet ports, and wherein said manifold body further comprises flow enhancing means for providing a shortened flow path between said inner inlet ports and said manifold outlet ports.

3. The manifold assembly of claim 2 wherein said inner ports comprise three inlet ports.

4. The manifold assembly of claim 1 further comprising high pressure recirculation means for directing a localized stream of coolant under high pressure from said outlet ports toward said pump suction inlet port, said localized coolant stream to prevent coolant vortex formation in said pump.

5. The manifold assembly of claim 4 wherein said recirculation means comprises a high pressure line for connection to a high pressure outlet of said coolant pump, and a pipe connected to said high pressure line having an opening disposed adjacent a center of said manifold coolant outlet port.

6. The manifold assembly of claim 1 further comprising one or more overflow ports for connection to a system coolant surge tank.

7. A cooling system for a large diesel engine, comprising:

one or more coolant pumps, each having an inlet suction port and a high pressure discharge port for connection to coolant passages at said engine to pass coolant through said passages;

a lubricant oil cooler, said cooler for cooling engine lubricant oil, said coolant comprising a plurality of coolant passages through which coolant is passed to cool said oil and a plurality of coolant outlet ports defined in a cooler head, said outlet ports comprising first and second outer ports and at least one inner port disposed between said outer ports, said outlet ports communicating with said coolant passages comprising said oil cooler;

a coolant manifold assembly disposed between said oil cooler and said one or more pump suction inlet ports for distributing coolant flow between said oil cooler outlet ports and said one or more suction inlet ports, said manifold assembly comprising a manifold body, a manifold coolant outlet port corresponding to each suction inlet port, a plurality of manifold inlet ports comprising an inlet port corresponding to each oil cooler outlet port, and flow distribution means for providing shortened flow paths between said inlet ports corresponding to said inner cooler outlet ports and said manifold outlet ports; and means for connecting said manifold outlet ports to said corresponding pump suction inlet ports, and means for connecting said manifold inlet ports to said corresponding oil cooler outlet ports, wherein said inner oil cooler outlet ports and said corresponding manifold inlet ports provide improved coolant flow through said oil cooler without the necessity for additional coolant pumps.

8. The cooling system of claim 7 wherein said oil cooler inner outlet ports comprise third, fourth and fifth outlet ports, and wherein said manifold inlet ports comprise corresponding third, fourth and fifth outlet ports.

9. The cooling system of claim 8 wherein said one or more coolant pumps comprise first and second pumps, and said manifold assembly comprises first and second manifold coolant outlet ports.

10. The cooling system of claim 9 wherein said manifold body comprises opposed first and second wall surfaces, said manifold inlet ports formed in said first wall surface, said manifold outlet ports defined by first and second outlet pipe members extending from said second wall surfaces, and wherein said flow distribution means comprises channel body means fitted between slot openings formed in said first and outlet pipe members and slot openings formed in said manifold body.

11. The system of claim 7 further comprising high pressure recirculation means for directing a localized stream of coolant under high pressure from said one or more outlet ports toward said one or more inlet suction ports, said localized coolant stream to prevent coolant vortex formation in said pump.

12. The system of claim 11 wherein said recirculation means comprises a high pressure line for connection to a discharge outlet of said coolant pump, and a pipe connected to said high pressure line having an opening disposed adjacent a center of said manifold coolant outlet port.

13. The system of claim 7 wherein said manifold assembly comprises one or more overflow ports for connection to a system coolant surge tank.

* * * * *